US010815928B2

(12) United States Patent
Wood

(10) Patent No.: US 10,815,928 B2
(45) Date of Patent: Oct. 27, 2020

(54) PREVENTING OVERSTROKE OF FREE-PISTON STIRLING ENGINE FROM LOSS OF LOAD

(71) Applicant: Sunpower, Inc., Athens, OH (US)

(72) Inventor: James Gary Wood, Albany, OH (US)

(73) Assignee: Sunpower, Inc., Athens, OH (US)

( * ) Notice: Subject to any disclaimer, the term of this patent is extended or adjusted under 35 U.S.C. 154(b) by 5 days.

(21) Appl. No.: 16/279,019

(22) Filed: Feb. 19, 2019

(65) Prior Publication Data

US 2020/0263631 A1 Aug. 20, 2020

(51) Int. Cl.

| | |
|---|---|
| ***F02G 1/047*** | (2006.01) |
| ***F02G 1/053*** | (2006.01) |
| ***F02G 1/043*** | (2006.01) |
| ***F02G 1/05*** | (2006.01) |

(52) U.S. Cl.

CPC ..... *F02G 1/047* (2013.01); *F02G 1/0435* (2013.01); *F02G 1/05* (2013.01); *F02G 1/053* (2013.01); *F02G 2243/24* (2013.01)

(58) Field of Classification Search

CPC .... F02G 1/0435; F02G 1/045–05; F02G 1/06; F02G 2243/24

See application file for complete search history.

(56) References Cited

U.S. PATENT DOCUMENTS

| | | | | |
|---|---|---|---|---|
| 4,330,993 | A * | 5/1982 | Beale | F01M 9/00 60/520 |
| 4,805,408 | A | 2/1989 | Beale et al. | |
| 5,537,820 | A | 7/1996 | Beale et al. | |
| 6,945,043 | B2 | 9/2005 | Okano et al. | |
| 8,307,700 | B2 | 11/2012 | Holliday et al. | |
| 8,590,301 | B2 | 11/2013 | Wood | |
| 2005/0268604 | A1 | 12/2005 | Takahashi et al. | |
| 2006/0137399 | A1 | 6/2006 | Sakamoto et al. | |
| 2007/0277521 | A1 | 12/2007 | Tanaka | |

FOREIGN PATENT DOCUMENTS

WO 2006067429 A1 6/2006

OTHER PUBLICATIONS

D.M. Berchowitz, Operational Characteristics of Free-Piston Stirling Engines, 23rd Intersociety Energy Conversion Engineering Conference, Book No. 10272A, pp. 107-112, vol. 1, The American Society of Mechanical Engineers.

* cited by examiner

*Primary Examiner* — Laert Dounis

(74) *Attorney, Agent, or Firm* — Kremblas & Foster; Frank H. Foster

(57) ABSTRACT

A method for limiting the amplitude of reciprocation of a piston reciprocating in a cylinder of a free-piston Stirling engine. The method is the combination of both at least partially covering the heat rejecter cylinder port by the piston sidewall during a peak part of the inward reciprocation of the piston and at least partially covering the heat rejecter cylinder port by the displacer sidewall during a peak part of the outward reciprocation of the displacer. The piston and the displacer, at times during their reciprocation, fully cover the effective heat rejecter cylinder port when the piston amplitude of reciprocation is large and approaches the physical limit of the amplitude of reciprocation in order to avoid internal collisions by a reciprocating component.

13 Claims, 4 Drawing Sheets

ENGINE OUTPUT POWER (watts) and DISPLACER PHASE ANGLE (degrees)
100
90
80
70
60
50
40
30
20
10
0
0.0
1.0
2.0
3.0
4.0
5.0
6.0
$X_P$ PISTON AMPLITUDE (mm)
$X_{Pmax}$
$X_{P4}$
$X_{P2}$
$X_{P3}$
$X_{Ppp}$
$X_{P1}$
Piston Covering Rejecter Port
Displacer Closes Rejecter Port
MP
IP
66
64
TP
PP
$\Phi_d$
TP

PREVENTING OVERSTROKE OF FREE-PISTON STIRLING ENGINE FROM LOSS OF LOAD

CROSS-REFERENCES TO RELATED APPLICATIONS (Not Applicable)

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates to preventing runaway instability and consequent overstroke of free-piston Stirling engines (FPSE) and more particularly relates to an improvement which reduces engine output power as piston stroke increases from the engine load becoming reduced or completely lost. This depowering prevents the instability associated with loss of load and avoids an increase of piston amplitude of reciprocation that would otherwise cause a runaway amplitude increase resulting in the piston having engine-damaging collisions with other internal engine components. The invention is able to reduce engine output power all the way to zero in the event of a complete loss of load but still allow the engine at zero output power to maintain the reciprocation of its piston and displacer without overstroking.

Prior Art FPSE.

FIG. 1 is a diagrammatic illustration of a free-piston Stirling engine in a beta configuration (displacer and piston in common cylinder) that embodies the invention. However, most of the engine's structural features that are symbolically illustrated in FIG. 1 are known in the prior art. Therefore, those features that an embodiment of the invention can have in common with the prior art are described in this "Background of the Invention" section. The distinguishing features of the invention are described in the other sections.

Referring to FIG. 1, in a Stirling engine a working gas is confined in a working space 8 comprised of a heat accepting expansion space 10, an opposite heat rejecting compression space 12 and a working gas flow path between the expansion space 10 and the compression space 12. The working gas flow path includes, in series fluid connection, a heat acceptor 14, which transfers externally applied heat into the working gas, a heat rejecter 16, which transfers heat out of the working gas, and an interposed regenerator 18. The flow path also includes a heat rejecter cylinder port 20 through an engine cylinder 22 at the cylinder's compression space 12 and a heat acceptor cylinder port 24 at the open end of the engine cylinder 22 at the cylinder's expansion space 10. The heat acceptor 14, heat rejecter 16 and regenerator 18 are formed annularly to surround the engine cylinder 22.

Because FIGS. 1 and 3 are diagrammatic or symbolic drawings directed to a person skilled in the art, they do not show some details that are known to those skilled in the art. In many FPSEs the heat rejecter cylinder port 20 consists of several individual, circumferentially elongated ports located at closely spaced intervals that are arranged annularly (circumferentially) around the cylinder and in common fluid communication between the interior of the cylinder 22 and the heat rejecter 16. The rejecter cylinder ports 20 are separated by a few, relatively narrow, circumferentially spaced, axially oriented ribs 27 connecting inward and outward segments of the cylinder 22. The ports 20 have an axial length from their inward edge to their outward edge but that is subsequently described in connection with FIG. 3 and the invention. It might also be noted that, because the heat rejecter cylinder port 20 is used in the singular ("port") for discussion of fundamental operating principles but actually consists of several spaced apart radially oriented ports the rejecter port is sometimes referred to in the singular and sometimes in the plural ("ports").

Heat is applied to the heat acceptor 14 and commonly to the entire head end 26 of the engine, such as by a gas flame or the application of concentrated solar energy. Heat is removed from the heat rejecter 16 by an external heat exchanger (not shown) that transfers the heat to the coolant of a cooling system.

Reciprocating motion of the piston 28 and a displacer 30 cause the working gas to be alternately heated and cooled and alternately expanded and compressed in order to do work on the piston 28 that reciprocates in the cylinder 22. The piston 28 has a sidewall 32 that engages and slides along the cylinder 22 and the sidewall 32 has an inward end 34. The terms "in", "inward", "out" and "outward" are a terminology convention used by those skilled in the art to describe the opposite axial directions of motion of engine components including the piston 28 and the displacer 30. The terms "in" and "inward" indicate a direction or position toward or nearer the working space 8, which includes the compression space 12 part of the working space 8. The terms "out" and "outward" indicate a direction or position away from or farther from the working space 8. The piston 28 also has an annular cutout or relieved portion to form a central cap or boss 36 that is unrelated to the invention. Its purpose is to occupy a volume of the compression space 12 which would otherwise be an unswept volume. The boss 36 is sometimes not used in free-piston Stirling engines and may be of reduced axial height or entirely eliminated in practicing the present invention.

The displacer 30 of a beta type Stirling engine typically reciprocates in the same cylinder 22. Although a displacer can have a uniform diameter along its entire axial length, as seen in FIG. 1 a displacer typically has a seal segment 35 with a sidewall 33 at its outward end 31 and a non-seal segment 37 which is axially longer and has a smaller diameter than the seal segment 35. The displacer 30 is connected through a displacer connecting rod 38 to a planar spring 40 that is mounted to a casing 42. The casing 42 surrounds a relatively large-volume back space 43 and also contains working gas. The reciprocating mass of the piston 28, the reciprocating mass of the displacer 30 and its connecting rod, which acts upon the planar spring 40, and the resiliently compressible and expansible working gas together form a resonant system which has been called a thermal oscillator.

The reciprocating displacer 30 cyclically shuttles the working gas between the compression space 12 and the expansion space 10 through the heat acceptor 14, the regenerator 18 and the heat rejecter 16. This shuttling cyclically changes the relative proportion of working gas in each space. Gas that is in the expansion space 10, and gas that is flowing into or out of the expansion space 10 through the heat acceptor 14 accepts heat from surrounding surfaces. Gas that is in the compression space 12 and gas that is flowing into or out of the compression space 12 through the heat rejecter 16 rejects heat to surrounding surfaces. The rejected heat is ordinarily transferred away by the cooling system. The gas pressure is essentially the same in both spaces 10 and 12 at any instant of time because the spaces 10 and 12 are interconnected through the working gas flow path between the expansion space 10 and the compression space 12 and that flow path has a relatively low flow resistance. However, the pressure of the working gas in the working space 8 as a whole varies cyclically and periodically. The periodic increase and decrease of the pressure of the working gas in the working space 8 drive both the piston 28 and the displacer 30 in reciprocation. The periodic pressure variations are caused by the resultant of two components that are out of phase with each other. The first component arises from the alternating net heating and cooling of the working gas in the workspace. When a majority of the working gas is in the compression space 12, there is a net heat rejection from the working gas and the first component of gas pressure variation decreases. When a majority of the working gas is in the expansion space 10, there is a net heat acceptance into the working gas and the first component of gas pressure variation increases. The second component of gas pressure variation is the result of piston motion which alternately compresses and expands working gas in the working space as a consequence of piston momentum.

Piston Centering.

FPSEs typically have a net flow of gas over the cycle from the working space to the back space. One cause is that gas passage through the piston/cylinder clearance gap has a net flow in the out direction even if the gap has a uniform shape and constant length. The reason is that, although the volume of gas flow is the same in both directions, the density of gas flowing out of the workspace is larger than the density of gas flowing into the workspace. The density is larger because the pressure of gas in the workspace, when gas flows out of the workspace, is greater than the pressure of gas in the back space when gas flows out of the back space. More importantly, for machines with gas bearings, the bearings tend to pump gas out of the working space to the back space such as by the flow through the gas bearing cavity 44 and out the gas bearing pads 50. The reason is that the entire input of gas into the gas bearing cavity 44 is from the workspace 8, but a substantial proportion of the gas passing out the gas bearing pads 50 flows into the back space 43. The cumulative effect of this preferential blow-by over many cycles is that the mean position of the piston creeps in. The mean position of a piston is the center or mid-point between the farthest excursions of the piston in opposite directions. The distance between the farthest opposite excursions of a point on the piston is the piston stroke and one half of the stroke is the piston amplitude of reciprocation.

The engine of FIG. 1 is provided with a centering system that compensates for this preferential blow-by and prevents the inward creep by the piston 28. The centering system illustrated in FIG. 1 includes a centering system piston passageway 52 (shown in dashed lines) extending from the inner end of the piston boss 36 and out through the sidewall 32 of the piston 28. The centering system also includes an annular groove 56 around the interior wall of the cylinder 22 that opens into the back space 43 through a centering cylinder passageway 54. Whenever the piston passageway 52 and the annular groove 56 come into registration, the centering system provides a gas conducting passageway between the back space 43 and the working space 8. They come into registration twice each cycle, once during each direction of travel of the piston 28. The engine is constructed so that they come into registration to permit gas flow between the back space 43 and the working space 8 when the piston is at or near it's designed mean position. More particularly, the passageway between the back space 43 and the working space 8 is opened whenever the piston is at a position that, if the piston were reciprocating around its designed mean position, the pressure difference between the pressure in the working space 8 and the pressure in the back space 43 at the two times of registration during each cycle would average zero. With zero average pressure difference there would be no net gas flow through the centering system during each cycle. However, if the mean piston position creeps in as a result of gas transfer from the working space 8 to the back space 43, then, at the position of registration, the averaged gas pressure in the back space 43, averaged over the two passings in registration, is greater than the average gas pressure in the working space 8 so there is a net gas flow from the back space to the working space. Consequently, if the piston mean position creeps in as a result of the preferential blow-by, gas will be returned from the back space 43 to the working space 8 whenever the gas passageway 52 is opened to the back space 43. Conversely, if the piston were to creep out as a result of transfer of working gas from the back space 43 to the working space 8, then, at the position of registration, the gas averaged pressure in the back space 43 is less than the pressure in the working space 8 so gas will be transferred back from the working space 8 to the back space 43.

Instability of a FPSE

A problem with free-piston Stirling engines is that historically they have not been tolerant of a loss of load. A kinematic Stirling machine that is adequately designed will, when its load is removed or reduced, often just run at a higher speed and the machine's internal heat exchanger pumping losses consume the power that ceased being consumed by the load. However a FPSE is a resonant machine and so, if unloaded, the frequency will not change significantly. Instead, the piston and displacer will over-stroke and collide with physical structures within the engine and with each other. The collisions often lead to failure of internal components and to the generation of debris which can lead to engine failure.

Referring to FIG. 2, most free-piston Stirling engines that are designed according to prior art principles have a typical engine power curve TP that relates engine output power to piston amplitude $X_p$. The piston amplitude $X_p$ is one half of the stroke of the piston 28. FIG. 2 shows a typical power output curve TP but the scales will vary from machine to machine. Commonly, an FPSE drives a linear alternator that supplies electrical power to an electrical load although there are useful applications where the engine drives a mechanical load. The instability problem can be considered with regard to an electrical load but is also applicable to mechanical loads.

In the absence of a controller or other means for limiting piston amplitude, engine power is an increasing exponential function of piston amplitude over the engine's operating range which is illustrated by the typical engine power curve TP. Typically engine power increases as the square of the piston amplitude. That makes the engine unstable with a linear load, such as a resistive electrical load for which the power consumed varies with voltage squared. Those skilled in the art of Stirling engines are familiar with the typical power curve TP of FIG. 2.

Considering FIG. 2, if a power curve for a load on the FPSE does not have a greater slope than the power curve for the engine, the engine does not have a stable operating point. In other words, the engine will not operate to regulate itself around an operating point in response to load variations. This instability means that the displacer and piston amplitudes of reciprocation progressively increase with the piston amplitude of reciprocation increasing along the typical power curve TP beyond the physical stroke limit of the machine at which collision occurs. Because a resistive electrical load has a power curve that, like the engine power curve, varies exponentially as the square of voltage, the slope of the load's power curve does not exceed the slope of the engine's power curve. Consequently, the engine is not stable. This can be considered the Achilles heel of the FPSE.

Prior Art Controller Solution.

The prior art uses an engine controller to overcome this instability and for additional reasons. The engine controller is commonly interposed between the output of the engine's alternator and the input of the ultimate electrical load. Therefore, the controller's input terminals are seen by the output of the engine's alternator as the engine's load. In normal operation the controller prevents the instability and runaway increase in piston and displacer amplitude of reciprocation. Unfortunately, there are occasions when a malfunction of the controller or a disconnection or shorting of a connection between the controller and the FPSE or its alternator causes the load seen by the FPSE to appear as an open circuit or as a short circuit. In either instance there is no load to consume engine output power and therefore the conditions for runaway piston amplitude exist.

Prior Art Berchowitz Solution.

A significant but only partially effective solution to the instability problem was described in a publication *Operational Characteristics of Free-Piston Stirling Engines*, D. M. Berchowitz, 1988, ASME, 23$^{rd}$ Intersociety Energy Conversion Engineering Conference Vol. 1, pages 107-112. In that publication Dr. Berchowitz described the concept of designing the physical and operating parameters of the FPSE so that the heat rejecter cylinder port 20 will be covered and blocked by the piston 28 during a part of each cycle of piston reciprocation.

Referring to FIGS. 1 and 2, the application of the Berchowitz concept to the instability problem is accomplished by designing the Stirling engine so that, when the piston amplitude of reciprocation approaches its amplitude at the peak power PP for which the engine is designed, the heat rejecter cylinder port 20 begins to be partially covered by the piston sidewall 32 at the inward peak of the piston motion. As the piston amplitude increases further, the passage of gas through the heat rejecter cylinder port 20 becomes progressively more blocked by the piston sidewall 32. With a sufficient increase in the piston's amplitude of reciprocation, the heat rejecter cylinder port 20 eventually becomes completely blocked during the inward peak of piston motion. The result of this blockage is that the power curve (FIG. 2) does not continue upward exponentially in the manner of a typical prior art exponential power curve TP. Instead, the power curve falls below the typical power curve TP and follows the downward path of the modified power curve MP of FIG. 2. The reason for this downturn of the modified power curve MP is that partial and complete blockage of the heat rejecter cylinder port 20 causes the phase lead of the displacer 30 to decrease and also increases pumping losses both through the ports as well as past the seal segment 35 of the displacer 30. As known in the art, a decrease of the displacer's phase lead ahead of the piston reduces engine power.

The Berchowitz prior art method is effective to a significant and useful point but experiment has revealed that it has a deficiency. The remaining problem is that it does not drive the engine output power completely to zero which is necessary to prevent overstroke in the event that the load cannot consume any power. Instead, as the piston amplitude of reciprocation approaches its greatest amplitude, the Berchowitz method allows engine power to reverse its decline and begin to increase as a function of piston amplitude of reciprocation. This turnaround is illustrated by the increased power curve IP of FIG. 2. Consequently, as the amplitude of piston reciprocation approaches its maximum, the prior art method allows the return of instability and a return to a runaway condition along the reversed power curve IP that would result in a return to overstroke and collisions.

It is therefore a general purpose and object of the invention to provide a FPSE which is tolerant of loss of engine load because it prevents overstroke by limiting piston amplitude of reciprocation thereby avoiding collisions and damage if the engine's load is reduced or becomes zero.

A more specific purpose and object of the invention is to overcome the above-described deficiency in the Berchowitz method for limiting the amplitude of reciprocation of the reciprocating components of a free-piston Stirling engine even in the event of a complete loss of load and/or failure of the engines controller.

BRIEF SUMMARY OF THE INVENTION

The invention is a modification of prior art free-piston Stirling engines that causes piston amplitude to be limited and engine output power to be reduced even to as low as zero in the event of a complete loss of load. The basic concept of the invention is to supplement the Berchowitz prior art method of reducing engine power as the output load on the engine decreases greatly or is entirely lost. The present invention is combined with the Berchowitz method by additionally covering the rejecter port by the displacer at times during each cycle of the displacer in order to supplement covering the rejecter port with the piston. This avoids the above-described deficiency.

More specifically, the invention is at least partially covering the heat rejecter cylinder port by the displacer sidewall during a peak of the outward reciprocation of the displacer

Figure 1:
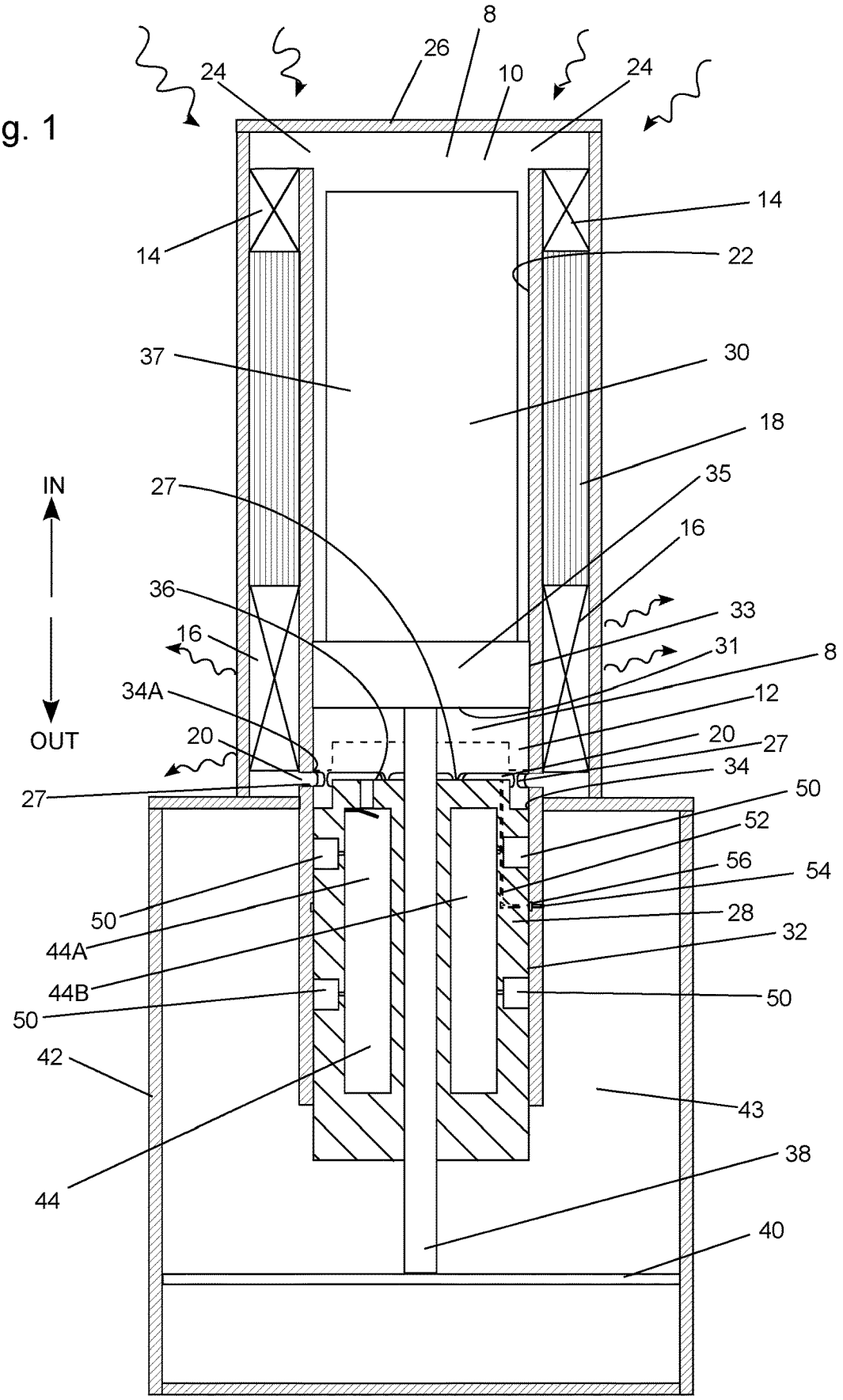
FIG. 1 is a diagrammatic and symbolic view in axial cross section of a beta type free-piston Stirling engine that embodies the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

The present invention improves upon the Berchowitz concept by combining it with the present invention in order to improve its practical effectiveness by causing the engine output power to be driven entirely to zero and limiting the piston to a maximum amplitude of reciprocation $X_{Pmax}$ before any damaging collisions occur. In applicant's prior application, applicant described the covering of the rejecter port by the piston in more detail. Applicant therefore incorporates herein by reference its application Ser. No. 15/494,836, Pub. No. US 2018/0112624 A1.

Figure 3:
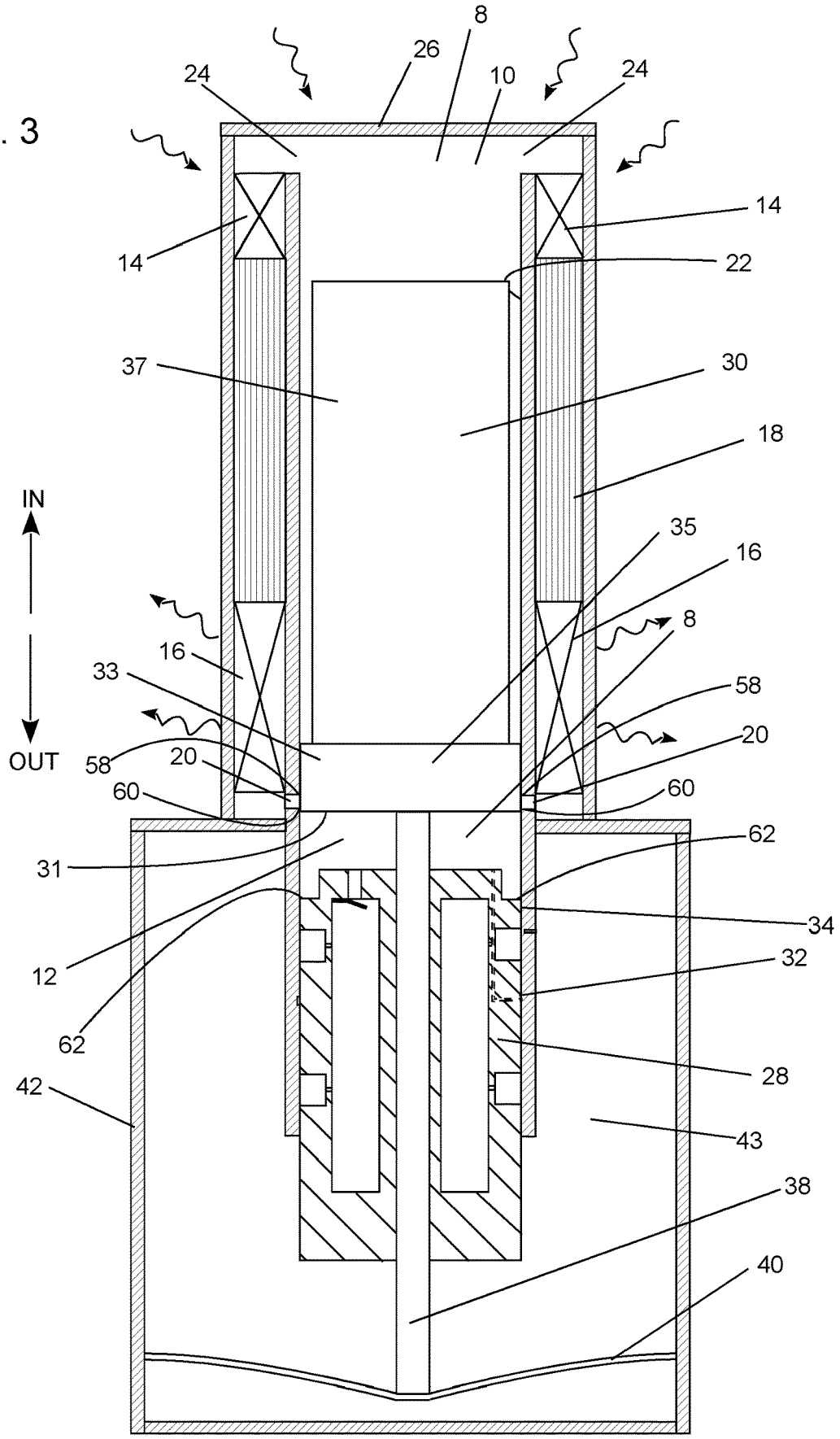
FIG. 3 is a diagrammatic and symbolic view in axial cross section showing the beta type free-piston Stirling engine of FIG. 1 with the displacer covering the heat rejecting port.

Referring to FIGS. 1 and 3, the invention is at least partially covering the heat rejecter cylinder port 20 by the piston sidewall 32 during a peak part of the inward reciprocation of the piston and additionally at least partially covering the heat rejecter cylinder port 20 by the displacer 30 sidewall 33 during a peak part of the outward reciprocation of the displacer 30. However, for a complete loss of load, the method will comprise both the piston sidewall 32 and the displacer sidewall 33 entirely covering the heat rejecter cylinder port 20 during those respective peak parts of their reciprocation. FIG. 1 shows with dashed lines the piston sidewall 32 advanced to its position 34A at which the piston sidewall 32 entirely covers the heat rejecter port 20 during the peak inward motion of the piston 28. FIG. 3 shows the sidewall 33 of the displacer 30 advanced to a position at which the displacer sidewall 33 entirely covers the heat rejecter port 20 during the peak outward motion of the displacer 30.

Figure 2:
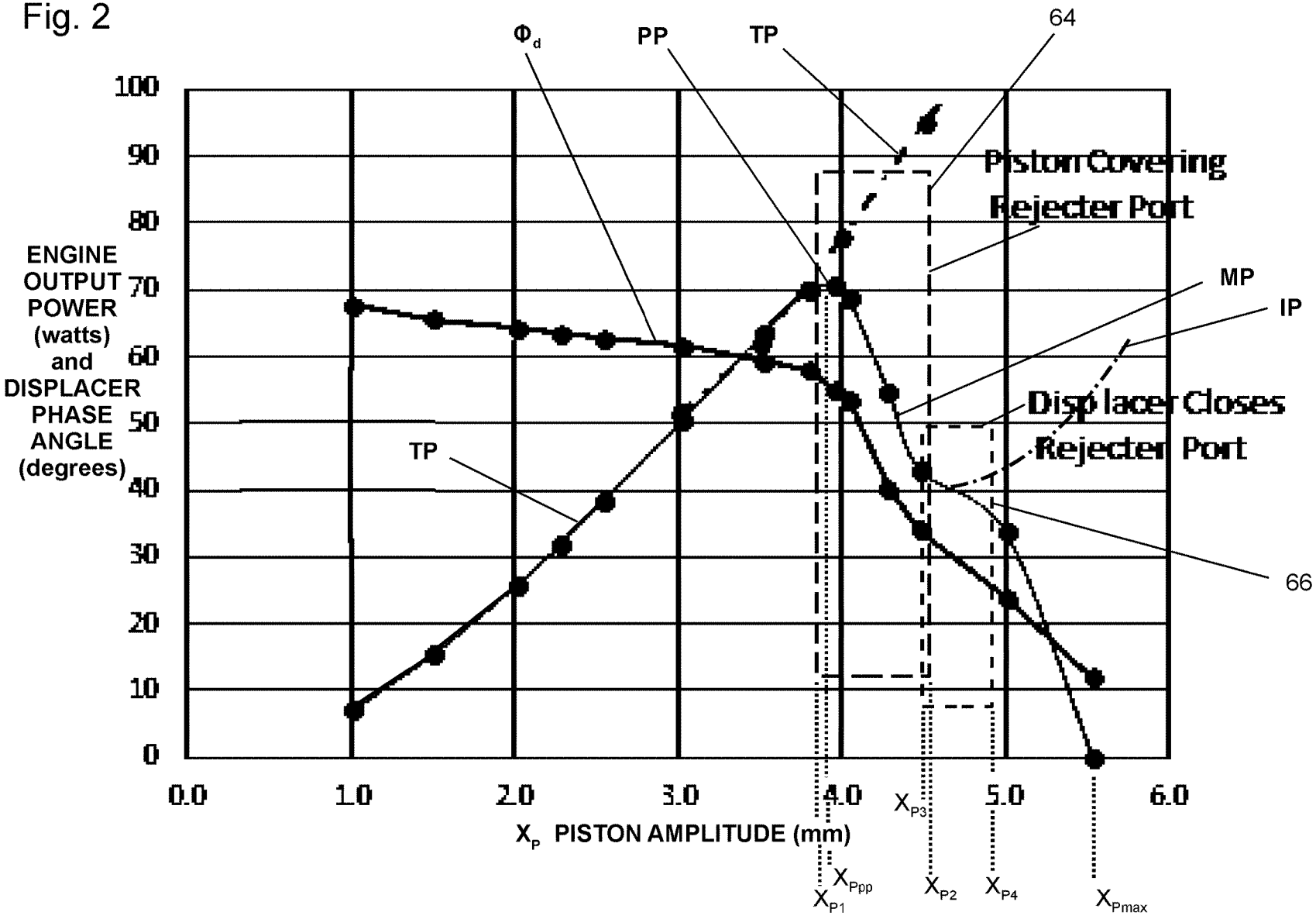
FIG. 2 is a graph showing a typical output power curve for an engine of the type illustrated in FIG. 1, a modified power curve that is the result of implementation of the invention and also illustrating the variation of engine output power as piston amplitude increases in an engine that implements the invention.

The graphs of FIG. 2 show test data from an operating prototype Stirling engine that implements the invention. The rectangle 64 represents the piston amplitude range during which the piston 28 covers progressively more of the heat rejecter port 20. The piston begins to cover the rejecter port 20 at piston amplitude $X_{P1}$ and eventually entirely covers the rejecter port 20 at piston amplitude $X_{P2}$. As the piston amplitude increases over the range from $X_{P1}$ to $X_{P2}$, engine output power initially increases at a reduced rate until it peaks at its peak power PP which occurs at piston amplitude $X_{Ppp}$. As the piston amplitude continues to increase, engine output power then declines along the modified power curve MP. As the piston amplitude increases further and the piston covers more of the rejecter port 20 during the peak of the piston's inward motion, engine output power declines at an increased rate. Immediately after the rejecter port 20 is entirely blocked at $X_{P2}$ engine output power continues to decline although at a reduced rate.

An engineer who is designing a free-piston Stirling engine ordinarily has a selected maximum engine output power as a principal design parameter. In order to implement the invention, the engine is designed so that the piston 28 begins to partially cover the heat rejecter cylinder port 20 at a piston amplitude of reciprocation $X_{P1}$ that is less than the piston amplitude of reciprocation $X_{Ppp}$ at the selected maximum engine output power PP. The piston 28 should progressively cover more of the heat rejecter cylinder port 20 as piston amplitude of reciprocation increases further. The piston 28 should entirely cover the heat rejecter cylinder port 20 at a piston amplitude of reciprocation $X_{P2}$ that is greater than its amplitude of reciprocation $X_{Ppp}$ at the selected maximum engine output power PP.

As previously described, in the event of a complete loss of load and in the absence of the invention, engine output power would turn upward along the line IP as piston amplitude increased thereby making the engine unstable. The rectangle 66 represents the piston amplitude range during which the displacer 30 covers progressively more of the heat rejecter port 20. In order to implement the invention and prevent the upturn, the engine is designed so that the displacer 30 begins to partially cover the heat rejecter cylinder port 20 at a piston amplitude of reciprocation $X_{P3}$ that is greater than the piston amplitude of reciprocation $X_{Ppp}$ at the selected maximum engine output power PP. Preferably, however, the engine is designed so that the displacer 30 begins to cover the heat rejecter port 20 at a piston amplitude of reciprocation $X_{P3}$ that is less than the piston amplitude of reciprocation $X_{P2}$ at which the piston entirely covers the heat rejecter port. As piston amplitude continues to increase, the sidewall 33 of the displacer 30 progressively covers more of the heat rejecter cylinder port 20. As piston amplitude of reciprocation increases still further, the displacer is made to eventually entirely cover the heat rejecter cylinder port 20 at a piston amplitude of reciprocation $X_{P4}$ that is less than the piston amplitude limit $X_{Pmax}$ and before engine output power has declined to zero output power.

The engineer may design the engine so that the displacer begins to cover the heat rejecter cylinder port before the piston amplitude of reciprocation $X_P$ increases to the amplitude $X_{P2}$ at which engine output power has declined to an engine output power that is 60% of the selected maximum engine output power. As seen in FIG. 2, engine output power has declined to approximately 60% at the $X_P$ data point that is coincident with the piston amplitude $X_{P2}$. Similarly, the engine may be designed so that the displacer has just completed fully covering the heat rejecter cylinder port before engine output power has declined to an engine output power that is 50% of the selected maximum engine output power. As seen in FIG. 2 for example, at a piston amplitude of reciprocation of $X_{P4}$ the output power has declined to approximately 50% of the selected maximum engine output power PP. In any event, the displacer should be made to entirely cover the heat rejecter port well before the engine output power has declined to zero because full coverage of the heat rejecter port by the displacer is believed to be needed to drive the engine output power completely to zero. It is desirable that the engine is designed so that the displacer has just completed fully covering the heat rejecter cylinder port before engine output power has declined to an engine output power that is greater than 20% of the selected maximum engine output power.

FIG. 2 also shows a graph $\Phi_d$ of displacer 30 phase lead ahead of the piston 28. Following the beginning of piston coverage of the heat rejecter port 20 at $X_{P1}$, the displacer phase gradually makes a transition to a higher rate of phase lead reduction which continues across the range from $X_{P1}$ to $X_{P2}$. That phase lead reduction continues after the displacer begins to close the heat rejecter port. So it can be seen in FIG. 2 that covering the heat rejecter port by both the piston and the displacer causes the reduction of displacer lead. In both cases power is reduced as a result of the sum of three components losses: (1) a reduction of displacer phase angle lead (2) pumping losses through the rejecter port as it becomes progressively more covered and therefore more restricted and (3) pumping losses past the displacer seal 35 after the rejecter port is completely covered resulting in more leakage past the displacer seal 35. However, the proportional division of power losses between these three components is different for the three types of port coverage.

Referring to FIG. 3, the piston amplitudes at which the displacer and the piston respectively begin to cover the heat rejecter cylinder port 20 is in part determined by the position of the inward edge 58 and the position of the outward edge 60 of the heat rejecter cylinder port 20. The distance between those two edges determines the width, in the axial direction, of the heat rejecter cylinder port 20.

The size of the rejecter port should not cause a reduction of engine power during normal engine operation when neither the piston nor the displacer has reached the rejecter port. Analysis has shown that, for most typical Stirling engines, power reduction begins when the cross sectional area of the rejecter port is about 80% (a factor of 0.8) of the effective (net) cross sectional area of the flow path through the rejecter. Although the factor of 0.8 is typical for most engines, that factor can be different for some Stirling engines. For example, analysis has shown that, for a large engine with a unique rejecter design, the factor is closer to 1.0. The cross sectional area of the rejecter ports is approximately the circumference of the cylinder 22 multiplied by the port width in the axial direction of the rejecter ports 20. It is approximate because of the existence of the ribs 27 which are narrow and therefore can be ignored for a first approximation. Therefore the minimum area of the rejecter ports 20 should not be less than 80% of the effective (net) cross sectional area of the flow path through the rejecter. Although not required, if we assume that the inward edge of the rejecter ports is positioned at its normally preferred position at the outward end of the rejecter 16, we can determine the minimum width $W_{P0}$ of the rejecter ports. This minimum width $W_{P0}$ is the smallest width in the axial direction that the rejecter port can be made without the size of the rejecter ports limiting the power output of the engine.

The cross sectional area of the rejecter ports is approximately equal to 80% of the cross sectional area of the effective (net) cross sectional area of the flow path through the rejecter 16 when $$W_{P0}[\pi D_{cylinder}]=0.8[A_{rejecter}]$$

Where $W_{P0}$=the minimum width of the rejecter ports;
$D_{cylinder}$=the diameter of the cylinder;
$A_{rejecter}$=the effective (net) cross sectional area of the flow path through the rejecter.

Therefore $$W_{P0} = 0.8\frac{A_{rejecter}}{\pi D_{cylinder}}$$

From that it follows that the axial width of the rejecter ports $W_P$ should be greater than or equal to (i.e. at least equal to) 0.8×[the effective (net) cross sectional area of the flow path through the rejecter] divided by [π×(the diameter of the cylinder)]. That is $$W_P \geq 0.8\frac{A_{rejecter}}{\pi D_{cylinder}}$$

Although that is a minimum rejecter port width, the outward edge 60 of the rejecter port 20 can be farther away from the assumed and usual position of the inward edge 58 than the minimum width $W_{P0}$. That results in a greater width and cross sectional area of the rejecter ports and will require a greater displacer amplitude before the output power is brought to zero by the action of displacer blockage of the ports.

The preceding assumes that the rejecter port is in the form of a circumferentially long slot as previously described. If instead of slots many closely circumferentially spaced drilled holes are used, the equations will be different but follow the principles outlined above.

The above analysis means that the rejecter port width in the axial direction should be at least the minimum rejecter port width $W_{P0}$. That condition assures that the port size does not reduce engine power output at piston amplitudes $X_P$ that are less than piston amplitude $X_P$ at the desired and designed maximum engine output power PP. If the rejecter port width in the axial direction is equal to the minimum rejecter port width $W_{P0}$, then the inward end 34 of the piston sidewall 32 should just begin to cover the heat rejecter cylinder port 20 (that is, reach the outer edge of the heat rejecter cylinder port 20) at a piston amplitude $X_{P1}$ at which the designer wants to initiate the engine output power reduction. The reason is that the effectiveness of covering the rejecter port begins when the width of the uncovered part of the rejecter port begins to be reduced below $W_{P0}$.

However, the rejecter port width can be greater than $W_K$. In that case, the inward end 34 of the piston sidewall 32 should be at a position that partially covers the heat rejecter cylinder port 20 and leaves the uncovered part of the cylinder port 20 with a width equal to $W_{P0}$ when the piston amplitude is at $X_{P1}$ (the amplitude at which the designer wants to initiate the engine output power reduction).

Based upon the above observations, the engineer who is designing the Stirling engine can select a piston amplitude at which engine output power will begin to be reduced. The FPSE is then designed so that the inward end 34 of the piston sidewall 32 will be positioned at a distance from the inward edge 58 of the heat rejecter cylinder port 20 that is equal to $$0.8\frac{A_{rejecter}}{\pi D_{cylinder}}$$

at the selected piston amplitude $X_{P1}$ at which engine output power will begin to be reduced. That distance is $W_{P0}$.

The principle that the effectiveness of covering the rejecter port 20 begins when the width of the uncovered part of the rejecter port 20 begins to be reduced below $W_{P0}$ is also applicable when the displacer covers the rejecter port 20. Therefore, the outward end 31 of the displacer 30 should be positioned so that its running outward excursion is inward from the outward edge 60 of the rejecter port 20 by the distance $W_{P0}$ when the designer wants the displacer 30 to begin to be effective in further reducing the engine output power. Referring to FIG. 2, the displacer should begin to be effective in further reducing the engine output power after the piston amplitude $X_P$ has exceeded the piston amplitude $X_{Ppp}$ at maximum engine output power PP. Preferably, as shown in FIG. 2, the displacer should begin to be effective in further reducing the engine output power before the piston amplitude $X_P$ increases to the piston amplitude $X_{P2}$ at which engine output power has declined further and the piston has fully covered the rejecter port.

Because covering the rejecter port with the displacer begins to become effective when the uncovered part of the rejecter port has an uncovered width of $W_{P0}$, the outward end 31 of the displacer 30 should be positioned by the distance $W_{P0}$ from the outward edge 60 of the rejecter port 20 at a piston amplitude that exceeds the piston amplitude $X_{Ppp}$ at maximum engine output power PP. And preferably, the outward end 31 of the displacer 30 should be positioned by the distance $W_{P0}$ from the outward edge 60 of the rejecter port 20 at a piston amplitude $X_{P3}$ that is less than the piston amplitude $X_{P2}$ at which the piston fully covers the rejecter port 20.

Figure 4:
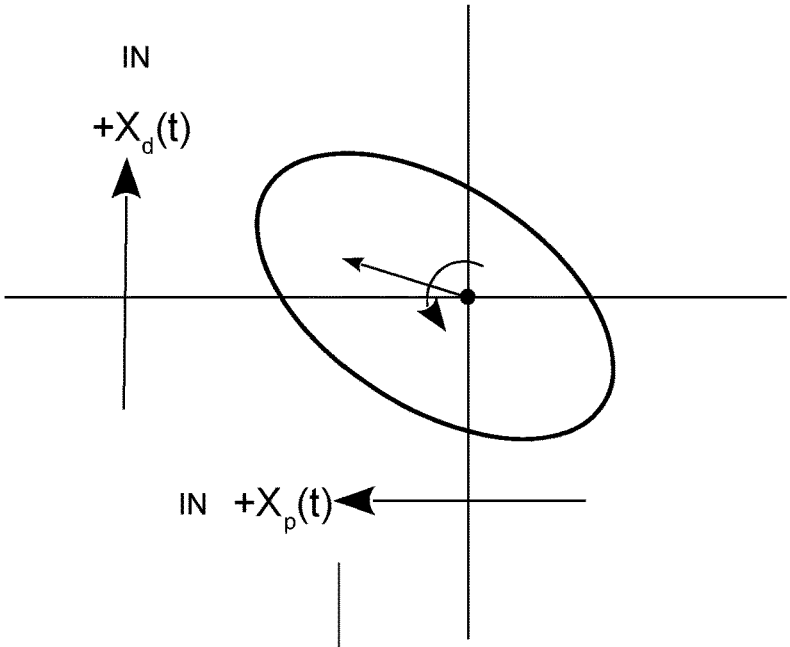
FIG. 4 is a Lissajous diagram showing piston and displacer motion when the rejecter port is not being periodically covered by the piston or the displacer.
Figure 5:
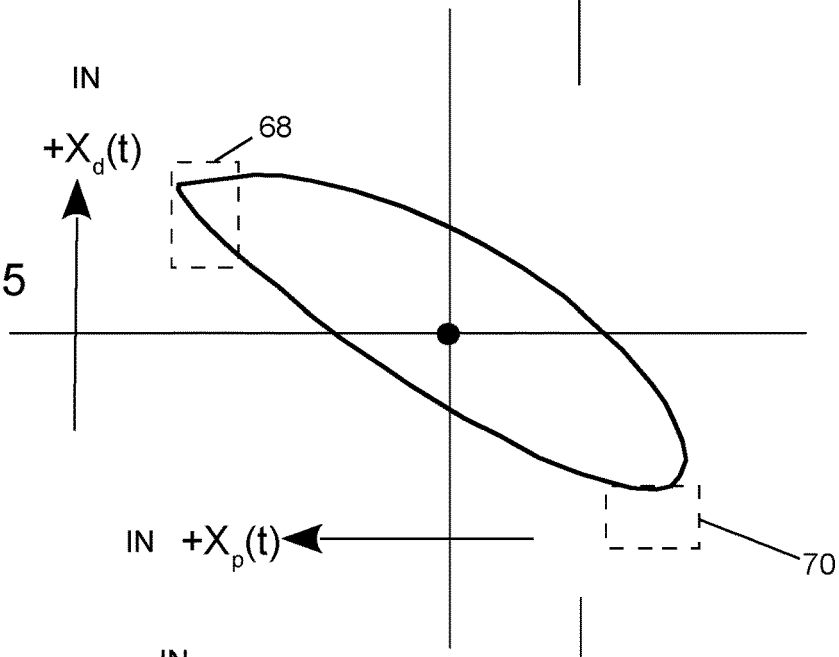
FIG. 5 is a Lissajous diagram showing piston and displacer motion when the rejecter port is being periodically partially covered by the piston.
Figure 6:
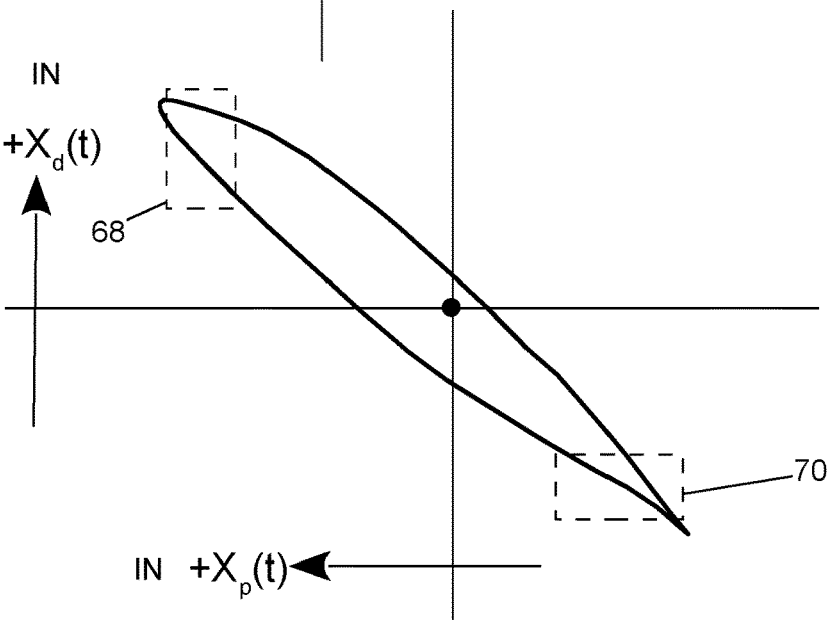
FIG. 6 is a Lissajous diagram showing piston and displacer motion when the rejecter port is being periodically fully covered by both the displacer and the piston with resulting zero power output from the engine.

Lissajous Graphs. FIGS. 4-6 are Lissajous graphs that were obtained from experimentation and illustrate the effectiveness of the invention on engine output power. They plot displacer versus piston position and the trace runs in a counterclockwise direction. The piston amplitude is represented on the horizontal axis and the displacer amplitude is represented on the vertical axis. Piston amplitude $X_P(t)$ is referenced from the position where the centering ports are in registration. That occurs when the centering system piston passageway 52 is aligned with the centering system annular cylinder groove 56. Displacer amplitude $X_d(t)$ is referenced from the point of static spring force of the planar spring 40; that is, when the planar spring is at its illustrated central position.

FIG. 4 shows operation of an engine when neither the piston nor the displacer covers any portion of the rejecter port during their cyclical excursions. In FIG. 5 the rejecter port is partially but not completely covered by the piston. In FIG. 6 the piston fully covers the rejecter port during a peak part the inward excursion of its reciprocation and the displacer fully covers the rejecter port during a peak part the outward excursion of its reciprocation. The regions on the graphs at which covering of the rejecter port occurs is illustrated by the dashed line boxes. The dashed line boxes 68 and 70 in FIGS. 5 and 6 represent the locations on the graphs at which the rejecter port is being covered. The boxes 68 show port coverage by the piston and the boxes 70 show port coverage by the displacer. More specifically, the vertical lines of the boxes 68 represent the piston position where the piston begins to cover the rejecter port and the piston position where the piston has completed fully covering the rejecter port. Consequently, the distance between the vertical lines of the boxes represents the range of piston positions over which the piston progressively covers the rejecter port with the vertical line closer to the vertical axis being the beginning of port coverage and the vertical line farther from the vertical axis being the completion of port coverage. Similarly, the horizontal lines of the boxes 70 represent the displacer position where the displacer begins to cover the rejecter port and the displacer position where the displacer has completed fully covering the rejecter port. Consequently, the distance between the horizontal lines of the boxes represents the range of displacer positions over which the displacer progressively covers the rejecter port with the horizontal line closer to the horizontal axis being the beginning of port coverage and the horizontal line farther from the horizontal axis being the completion of port coverage.

The Lissajous graphs also indicate that covering of the rejecter ports 20 also have an influence on the mean position of the piston 28 and the displacer 30. This is most evident in FIG. 6 which shows that the displacer 30 mean position has been pulled outward when the displacer covers the rejecter port 20. That is because, with the displacer 30 covering the rejecter port 20, the working gas that is between the piston and the displacer is trapped or confined in a closed space between them so the piston pulls the displacer outward along with the piston.

Those skilled in the art are capable of designing a free-piston Stirling engine to have a selected amplitude under the operating conditions of their choice. Of course engineering design is not perfected to the extent that a prototype always operates exactly according to its design parameters. So persons skilled in the art can build a prototype engine, test it and then modify its design to obtain the design parameters they want. Repetition of the design, build, test and modify procedure is a common iterative process that eventually leads to a desired operation.

REFERENCE NUMBER LIST working space 8
heat accepting expansion space 10
heat rejecting compression space 12
heat acceptor 14
heat rejecter 16
regenerator 18
heat rejecter cylinder port 20
engine cylinder 22
heat acceptor cylinder port 24
entire head end 26
ribs 27 separating the rejecter ports 20
piston 28
displacer 30
outward end 31 of displacer 30
piston sidewall 32
sidewall 33 of displacer 30
inward end 34 of piston sidewall 32
seal segment 35 of displacer 30
boss 36
non-seal segment 37 of displacer 30
displacer connecting rod 38
planar spring 40
casing 42
large volume back space 43
gas bearing cavity 44, 44A and 44B
gas bearing pads 50
centering system piston passageway 52
centering system cylinder passageway 54
centering system annular cylinder groove 56
inward edge 58 of rejecter cylinder port 20
outward edge 60 of rejecter cylinder port 20
inward end 62 of piston 28
piston amplitude range 64 over which the rejecter port is progressively covered by the piston
piston amplitude range 66 over which the rejecter port is progressively covered by the displacer
part of the cycle 68 during which the piston at least partially covers the rejecter port
part of the cycle 70 during which the displacer at least partially covers the rejecter port This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A method for limiting the amplitude of reciprocation of a piston reciprocating in a cylinder of a free-piston Stirling engine, the piston having a sidewall interfacing the cylinder and the piston sidewall having a circumferentially continuous end part at an inward end, the engine also including a displacer reciprocating in the cylinder and having a circumferentially continuous end part of the displacer sidewall at a displacer outward end, the engine further including a compression space interposed between the piston and the displacer and a heat rejecter cylinder port through the engine cylinder and opening into the compression space, wherein the method comprises:

(a) at least partially covering the heat rejecter cylinder port by the circumferentially continuous end part of the piston sidewall during a peak of the inward reciprocation of the piston; and (b) at least partially covering the heat rejecter cylinder port by the circumferentially continuous end part of the displacer sidewall during a peak of the outward reciprocation of the displacer.

2. The method according to claim 1 wherein both the piston sidewall and the displacer sidewall entirely and continuously cover the heat rejecter cylinder port during peaks of their reciprocation.

3. The method according to claim 1 wherein the engine has a selected maximum engine output power for which the engine was designed and the piston begins to partially cover the heat rejecter cylinder port at a piston amplitude of reciprocation ($X_{P1}$) that is less than a piston amplitude of reciprocation at the selected maximum engine output power, progressively covers more of the heat rejecter cylinder port as piston amplitude of reciprocation increases further and entirely covers the heat rejecter cylinder port at a piston amplitude of reciprocation ($X_{P2}$) that is greater than its amplitude of reciprocation ($X_{Ppp}$) at the selected maximum engine output power.

4. The method according to claim 3 wherein the displacer begins to partially cover the heat rejecter cylinder port at a piston amplitude of reciprocation that is greater than the piston amplitude of reciprocation ($X_{Ppp}$) at the selected maximum engine output power, the displacer progressively covers more of the heat rejecter cylinder port as piston amplitude of reciprocation increases further and the displacer entirely covers the heat rejecter cylinder port at a piston amplitude of reciprocation ($X_{P3}$) that is less than a piston amplitude limit ($X_{Pmax}$) and before engine output power has declined to zero output power.

5. The method according to claim 3 wherein the displacer begins to cover the heat rejecter port at a piston amplitude of reciprocation ($X_{P3}$) that is less than the piston amplitude of reciprocation ($X_{P2}$) at which the piston entirely covers the heat rejecter port.

6. The method according to claim 4 wherein the displacer begins to cover the heat rejecter cylinder port before engine output power has declined to an engine output power that is 60% of the selected maximum engine output power.

7. The method according to claim 4 wherein the displacer entirely covers the heat rejecter cylinder port before engine output power has declined to an engine output power that is greater than 20% of the selected maximum engine power.

8. The method according to claim 7 wherein the displacer entirely covers the heat rejecter cylinder port before engine output power has declined to a selected engine output power that is 50% of the selected maximum engine output power.

9. The method according to claim 4 wherein the free-piston Stirling engine includes a working gas flow path between an expansion space and the compression space, the gas flow path including, in series fluid connection, a heat acceptor, which transfers externally applied heat into the working gas, a heat rejecter, which transfers heat out of the working gas, and an interposed regenerator, the heat rejecter cylinder port has an inward edge, the rejecter has an effective (net) cross sectional area of the flow path through the rejecter, and the method further comprises (a) selecting a piston amplitude at which engine output power will begin to be reduced;

(b) at said selected piston amplitude positioning the inward end of the piston sidewall at a distance outward from the inward edge that is equal to $$0.8\frac{A_{rejecter}}{\pi D_{cylinder}}$$

in which $D_{cylinder}$=the diameter of the cylinder;

$A_{rejecter}$=the effective (net) cross sectional area of the flow path through the rejecter.

10. The method according to claim 9 wherein the selected piston amplitude ($X_{P1}$) is less than piston amplitude ($X_{Ppp}$) at maximum engine output power (PP).

11. The method according to claim 4 wherein the free-piston Stirling engine includes a working gas flow path between an expansion space and the compression space, the gas flow path including, in series fluid connection, a heat acceptor, which transfers externally applied heat into the working gas, a heat rejecter, which transfers heat out of the working gas, and an interposed regenerator, the heat rejecter cylinder port has an inward edge and an outward edge, the rejecter has an effective (net) cross sectional area of the flow path through the rejecter, and the method further comprises (a) selecting a piston amplitude at which the displacer begins to become effective to further reduce engine output power;

(b) at the selected piston amplitude positioning the outward end of the displacer sidewall at a distance inward from the outward edge that is equal to $$0.8\frac{A_{rejecter}}{\pi D_{cylinder}}$$

in which $D_{cylinder}$=the diameter of the cylinder;

$A_{rejecter}$=the effective (net) cross sectional area of the flow path through the rejecter.

12. The method according to claim 11 wherein the selected piston amplitude is greater than piston amplitude ($X_{Ppp}$) at maximum engine output power (PP).

13. The method according to claim 12 wherein the selected piston amplitude is greater than piston amplitude ($X_{P2}$) at which the piston fully covers the rejecter port.

* * * * *